US005926892A

United States Patent [19]

Fukuhara et al.

[11] Patent Number: 5,926,892

[45] Date of Patent: Jul. 27, 1999

[54] HEAT EXCHANGER WASHING APPARATUS AND HEAT EXCHANGER WASHING METHOD

[75] Inventors: Koji Fukuhara; Fumitaka Sugishima, both of Osaka, Japan

[73] Assignee: Kyokuto Rubber Co., Ltd., Osaka, Japan

[21] Appl. No.: 09/048,319

[22] Filed: Mar. 26, 1998

[51] Int. Cl.[6] ..... B08B 9/04

[52] U.S. Cl. ..... 15/3.5; 15/104.062; 165/95

[58] Field of Search ..... 15/3.5, 3.51, 3.52, 15/104.062; 165/95

[56] References Cited

U.S. PATENT DOCUMENTS

| | | | |
|---|---|---|---|
| 3,215,195 | 11/1965 | Treplin | 165/95 |
| 3,291,197 | 12/1966 | Kollerup | 165/95 |
| 3,919,732 | 11/1975 | Honma | 165/95 |
| 5,640,734 | 6/1997 | Kuwashima | 15/3.5 |

*Primary Examiner*—Randall E. Chin

*Attorney, Agent, or Firm*—Kanesaka & Takeuchi

[57] ABSTRACT

A heat exchanger washing apparatus comprises a hopper for accommodating a plurality of washing brushes, a first heat exchanger leading guide having a first guide passage for guiding the washing brushes, a first opening/closing member for opening and closing the first guide passage, a first stopper disposed to the first guide passage, a second stopper, an air introduction passage communicating with the connecting port of the first guide passage downstream of the portion thereof where the first opening/closing member is disposed, a second opening/closing member for opening and closing the air introduction passage, a second heat exchanger leading guide connected to the first guide passage downstream of the connecting port and having a second guide passage for guiding the washing brushes with the extreme end of the second guide passage serving as an inserting portion which will be inserted into the pipe of a heat exchanger, first stopper control means, second stopper control means, first opening/closing control means for opening or closing the first opening/closing member, and second opening/closing control means for opening or closing the second opening/closing member.

1 Claim, 8 Drawing Sheets

HEAT EXCHANGER WASHING APPARATUS AND HEAT EXCHANGER WASHING METHOD

BACKGROUND OF THE INVENTION

1. Field of the Invention

The present invention relates to a heat exchanger washing apparatus and a heat exchanger washing method, and more specifically, to a heat exchanger washing apparatus and a heat exchanger washing method capable of securely supplying washing brushes into the pipes of a heat exchanger so that they travel in the pipes.

2. Description of the Related Art

Conventionally, since the efficiency of heat exchangers such as, for example, condensers for condensing the steam exhausted from nuclear power stations and thermal electric power plants by cooling the steam is lowered by the material such as scale and the like deposited on the inner walls of the pipe, the heat exchangers are periodically washed using a heat exchanger washing apparatus.

The heat exchanger washing apparatus is disclosed in, for example, Japanese Unexamined Patent Publication No. 8-145598. The apparatus disclosed therein is arranged such that a washing brush supplied from the feed passage of a washing brush accommodating body is accommodated in the accommodating portion of a direction converting member, after the washing brush is accommodated, the direction converting member is turned to shut off the communication between the accommodating portion of the direction converting member and the feed passage as well as the accommodating portion of the direction converting member is caused to communicate with a heat exchanger leading guide for supplying a high pressure fluid and thereafter the high pressure fluid is supplied to the heat exchanger leading guide. The washing brush which was sprayed with the high pressure fluid on the back side thereof travels in the pipe of a heat exchanger and is discharged to the outside of the pipe together with the deposited material in such a manner that the washing brush pushes out the deposited material.

Since the accommodating portion of the direction converting member has a space sufficient to accommodate only one washing brush and the washing brush is formed to a cylindrical shape and used repeatedly, the size thereof may be reduced by the use and the like thereof.

When the washing brush whose height is somewhat lowered by the use is accommodated in the accommodating portion of the direction converting member, since a slight surplus space is formed above the washing brush accommodated in the accommodation portion, a portion of a washing brush to be accommodated next invades on the washing brush having been accommodated in the accommodating portion, and moreover since the direction converting member turns in this state, there is a problem that a portion of the invaded washing brush which will be accommodated next is broken.

If the above phenomenon should arise even once, since the height of the brush is lowered in correspondence to the amount of breakage, there also arises a problem that the washing brushes are continuously broken one after another as well as the broken washing brushes invade into the turning portion of the direction converting member to thereby prevent the turn of the direction converting member.

An object of the present invention is to provide a heat exchanger washing apparatus and a heat exchanger washing method for solving the above problems.

SUMMARY OF THE INVENTION

To achieve the above object, a heat exchanger washing apparatus of the present invention is characterized by comprising a hopper for accommodating a plurality of washing brushes, a first heat exchanger leading guide standing on the hopper by being connected thereto and having a first guide passage for guiding the washing brushes from the hopper, a first opening/closing member for opening and closing the first guide passage, a first stopper disposed to the first guide passage upstream of the portion thereof where the first opening/closing member is disposed for stopping the washing brushes, a second stopper disposed to the first guide passage upstream of the portion thereof where the first stopper is disposed for stopping the washing brushes, an air introduction passage communicating with the connecting port of the first guide passage downstream of the portion thereof whether the first opening/closing member is disposed, a second opening/closing member for opening and closing the air introduction passage, a second heat exchanger leading guide connected to the first guide passage downstream of the connecting port and having a second guide passage for guiding the washing brushes with the extreme end of the second guide passage serving as an inserting portion which will be inserted into the pipe of an heat exchanger, first stopper control means for keeping or releasing the stop function of the first stopper, second stopper control means for keeping or releasing the stop function of the second stopper, first opening/closing control means for opening or closing the first opening/closing member, and second opening/closing control means for opening or closing the second opening/closing member.

A heat exchanger washing method of the present invention, which includes a hopper for accommodating a plurality of washing brushes, a first heat exchanger leading guide standing on the hopper by being connected thereto and having a first guide passage for guiding the washing brushes from the hopper, a first opening/closing member for opening and closing the first guide passage, a first stopper disposed to the first guide passage upstream of the portion thereof where the first opening/closing member is disposed for stopping the washing brushes, a second stopper disposed to the first guide passage upstream of the portion thereof where the first stopper is disposed for stopping the washing brushes, an air introduction passage communicating with the connecting port of the first guide passage downstream of the portion thereof whether the first opening/closing member is disposed, a second opening/closing member for opening and closing the air introduction passage, and a second heat exchanger leading guide connected to the first guide passage downstream of the connecting port and having a second guide passage for guiding the washing brushes with the extreme end of the second guide passage serving as an inserting portion which will be inserted into the pipe of an heat exchanger, is characterized by comprising the steps of opening the first opening/closing member, closing the second opening/closing member and stopping the washing brushes by the second stopper, releasing the first stopper to thereby introduce the washing brush having located under the washing brushes stopped by the second stopper to the second guide passage, and closing the first opening/closing member, opening the second opening/closing member and launching the washing brush in the second guide passage from the inserting portion by the air from the air introduction passage and causing the washing brush to travel in the pipe of the heat exchanger to thereby discharge the material deposited on the inner surface of the pipe to the outside of the pipe in the heat exchanger.

A heat exchanger washing method according to claim 3 is arranged such that the steps of closing the first opening/closing member, opening the second opening/closing member and introducing only the air from the inserting portion into the pipe of the heat exchanger without introducing the washing brush into the second guide passage to thereby discharge the washing brush stopping in the midway of the pipe are added to the heat exchanger washing method according to claim 2.

A heat exchanger washing method according to 4 is arranged in the heat exchanger washing method according to claim 2 or claim 3 such that each of the washing brushes is formed to an approximately cylindrical shape having a diameter D and a height H (D<H), the hopper has an opening formed to the lower portion thereof, the opening communicates with the first guide passage through a first guide passage introducing portion, the first guide passage introducing portion has an inlet formed to an approximately square shape satisfying L×M (L≦M, D<L<H, D<M<H) and includes a reciprocally moving member which moves in a perpendicular direction, and the reciprocally moving member is reciprocally moved in the perpendicular direction to thereby introduce the washing brush into the first guide passage from the first guide passage introducing portion in a standing state.

DESCRIPTION OF THE PREFERRED EMBODIMENT

Figure 1:
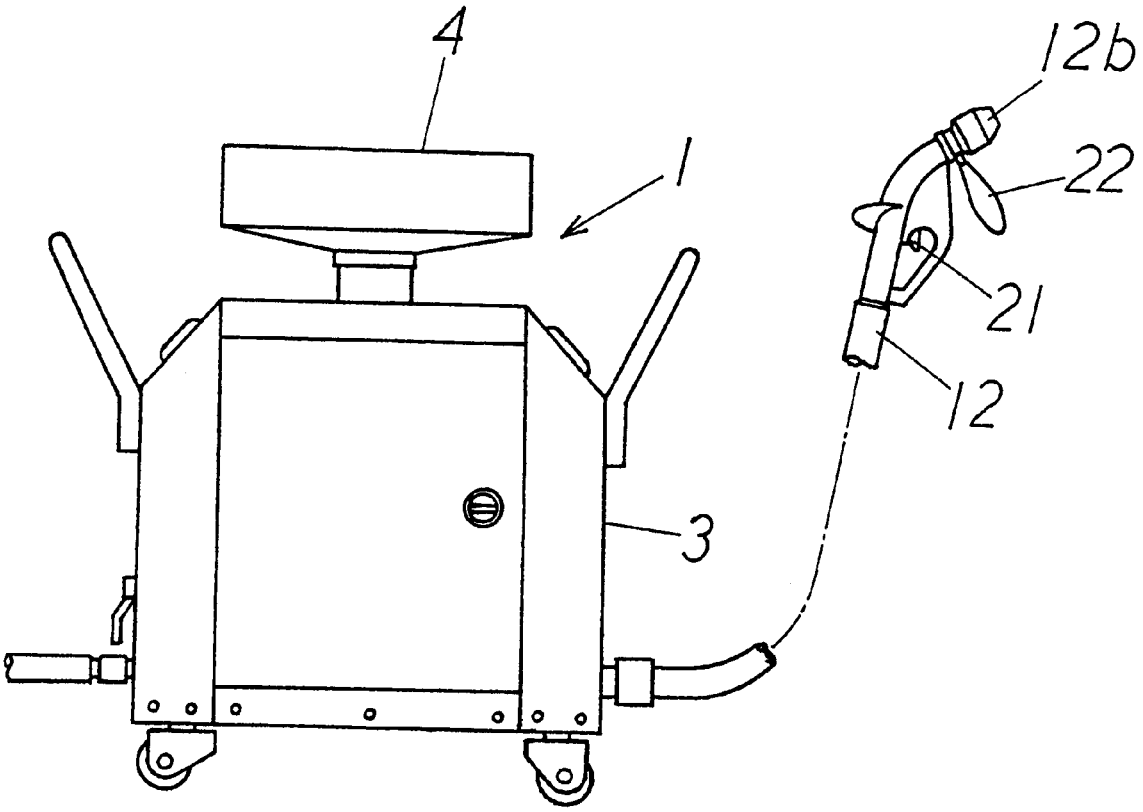
FIG. 1 is a schematic front elevational view of an embodiment of a heat exchanger washing apparatus according to the present invention.

An embodiment of a heat exchanger washing apparatus and a heat exchanger washing method of the present invention will be described with reference to the drawings.

A heat exchanger washing apparatus 1 is a launcher for causing a washing brush 2 to travel in the pipe 100 of a heat exchanger and the launched washing brush 2 travels in the pipe 100 of the heat exchanger and is discharged from the pipe 100 in such a manner that it pushes out the material deposited on the inner wall of the pipe 100 to the outside of the pipe 100. The washing brush 2 is formed to an approximately cylindrical shape having, for example, a diameter D (about 30 mm), a height H (about 50 mm) with the relationship of diameter D<height H, although the dimension is different depending upon the diameter of the pipe 100 of the heat exchanger as an object to be washed.

A main body 3 with casters is provided with a hopper 4 which is disposed above it to accommodate the washing brushes 2 at random.

The hopper 4 has a square open portion 4*a* formed to the upper portion thereof, an opening 4*b* formed to the lower portion thereof so as to communicate with a first guide passage introducing portion 5 to be described later and smaller than the open portion 4*a* and guide portions 4*c* inclined toward the opening 4*b*.

The opening 4*b* communicates with a first guide passage 6*a* to be described later at the first guide passage introducing portion 5.

The first guide passage introducing portion 5 has an inlet formed to an approximately square shape having the relationship of L×M (L≦M, D<L<H, D<M<H and, for example, L=M=32 mm). The first guide passage introducing portion 5 has a reciprocally moving member 5*a* which reciprocally moves in a perpendicular direction. The reciprocally moving member 5*a* has an inclined guide whose lower portion is located at the exit 5*c* of the first guide passage introducing portion 5 and is reciprocally moved in the perpendicular direction by a reciprocally moving cylinder 5*d*.

Since the inlet of the first guide passage introducing portion 5 is formed to the approximately square shape having the relationship of L×M (L≦M, D<L<H, D<M<H and, for example, L=M=32 mm), the washing brush 2 is not guided into the first guide passage introducing portion 5 and the first guide passage 6*a* unless it is in a standing state. The washing brush 2 is guided in such a manner that the reciprocally moving member 5*a* is reciprocally moved in the perpendicular direction by the cylinder 5*d* by means of reciprocal movement control means 105 to be described below as shown in FIG. 5 to FIG. 8.

Note, although it is preferable that the opening 4*b* communicates with the first guide passage 6*a* through the first guide passage introducing portion 5 and the reciprocally moving member 5*a* is provided with the first guide passage introducing portion 5 as described above, the reciprocally moving member 5*a* may be omitted and a standing washing brush accommodating member (8) may be employed as described in Japanese Unexamined Patent Publication No. 8-145598 depending upon a case.

A first heat exchanger leading guide 6 is connected to the hopper 4 through the opening 4*b* of the hopper 4 and the first guide passage introducing portion 5 and stands in an approximately perpendicular direction. Further, the first heat exchanger leading guide 6 includes the first guide passage 6*a* for guiding the washing brush 2 from the hopper 4.

A first opening/closing member 7 (which is, for example, an opening/closing valve, and more specifically, a ball valve) opens and closes the first guide passage 6*a* through first opening/closing control means 103 which will be described later to thereby regulate or permit the passage of the washing brush 2.

A first stopper 8 for stopping the washing brush 2 is disposed to the first guide passage 6*a* upstream of the portion thereof where the first opening/closing member 7 is disposed (the term "upstream" is used with respect to the flow of the washing brush 2, and more correctly, means the upstream side of the flow of the washing brush 2, the washing brush 2 flowing to the hopper 4, the opening 4*b*, the first guide passage introducing portion 5, the first guide passage 6*a* and a second guide passage 12*a* which will be described later). The first stopper 8 is composed of, for example, a pin cylinder driven by air and exhibits a stopper function by a rod 8*a* which projects into the first guide passage 6*a*. In addition, a first-dash stopper 8' having a rod 8'*a* is disposed in confrontation with the rod 8*a*.

A second stopper 9 is disposed to the first guide passage 6*a* upstream side of the portion thereof where the first stopper 8 is disposed to stop the washing brush 2. The second stopper 9 is composed of, for example, a pin cylinder driven by air and exhibits a stopper function by a rod 9*a* which projects into the first guide passage 6*a*.

An fluid introduction passage, which communicates with the connecting port 6*b* of the first guide passage 6*a* and introduces a fluid such as, for example, an air introduction passage 10 for introducing air having a pressure sufficient to cause the washing brush 2 to travel in the pipe 100 of the heat exchanger, is disposed to the first guide passage 6*a* downstream of the portion thereof where the first opening/closing member 7 is disposed (the term "downstream" is used with respect to the flow of the washing brush 2, and more correctly, means the downstream side of the flow of the washing brush 2, the washing brush 2 flowing to the hopper 4, the opening 4*b*, the first guide passage introducing portion 5, the first guide passage 6*a* and the second guide passage 12*a* which will be described later). The air introduction passage 10 is provided with a second opening/closing member 11 for opening and closing the air introduction passage 10.

The second opening/closing member 11 is, for example, an opening/closing valve, and more specifically, a ball valve and controls the air supplied to the second guide passage 12*a* which will be described later by opening and closing the air introduction passage 10. A high pressure air source (for example, 5 $Kg/cm^2$ to 7 $Kg/cm^2$) is connected to an end of the air introduction passage 10.

A second heat exchanger leading guide 12 having the second guide passage 12*a* for guiding the washing brush 2 is connected to the first guide passage 6*a* downstream of the connecting port 6*b*. The extreme end of the second guide passage 12*a* of the second heat exchanger leading guide 12 is arranged as an inserting portion 12*b* into which the pipe 100 of the heat exchanger is inserted.

Figure 2:
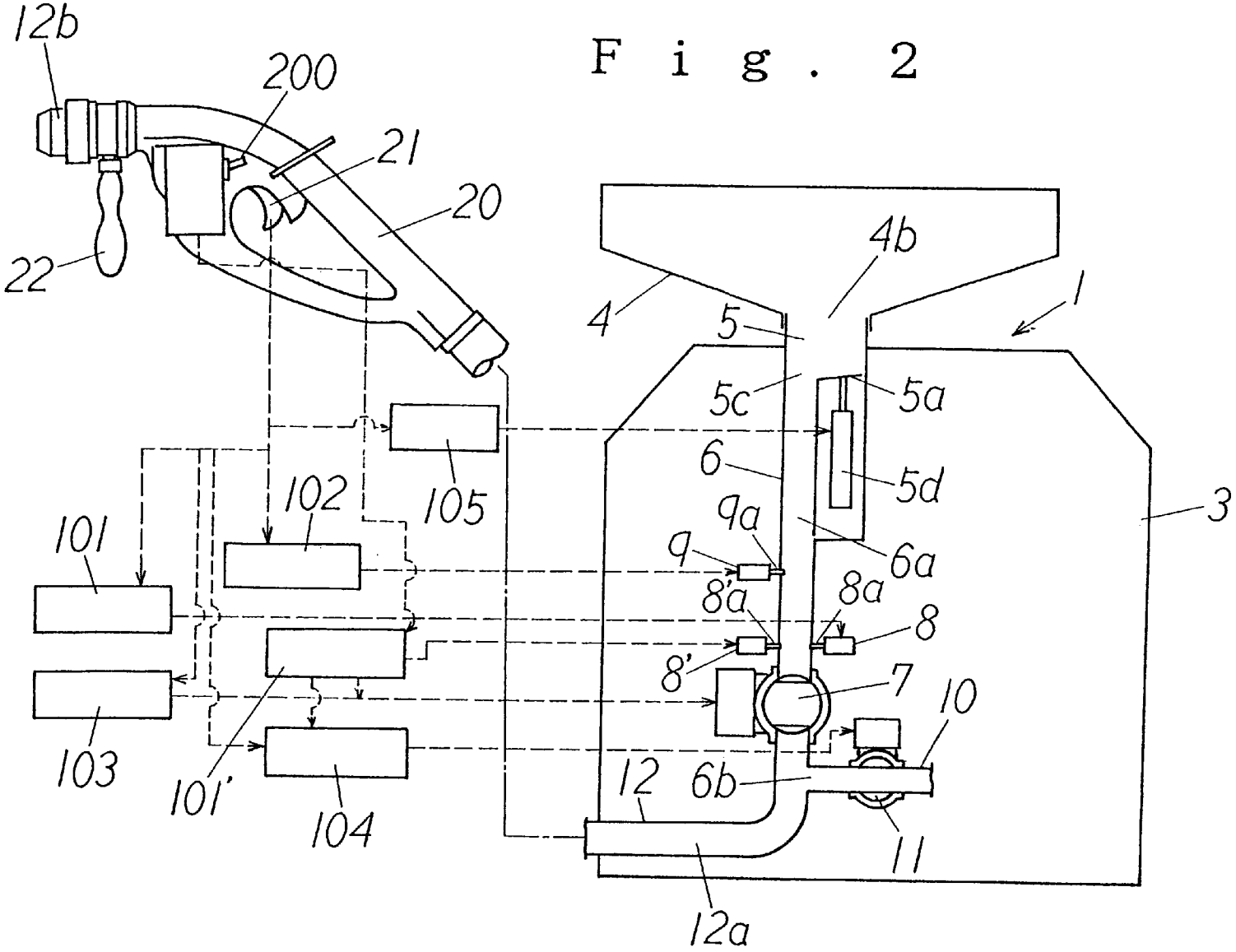
FIG. 2 is a view schematically explaining how the heat exchanger washing apparatus in FIG. 1 is controlled.
Figure 3:
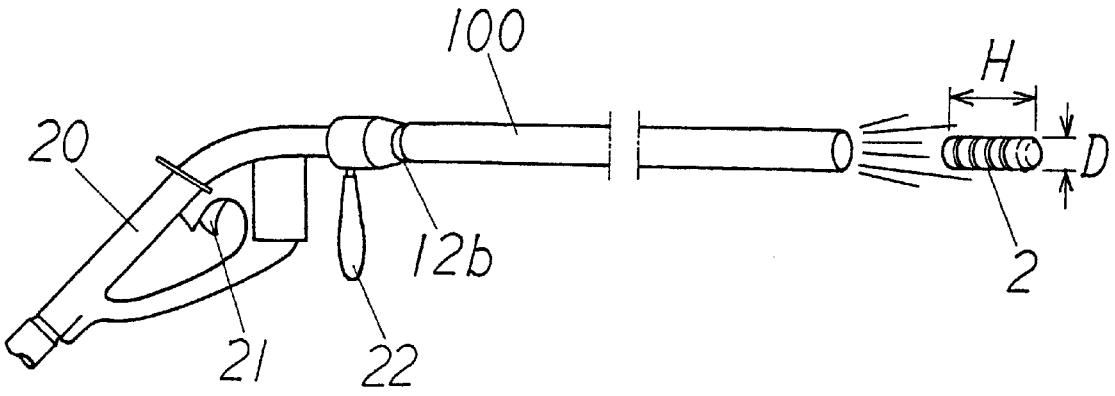
FIG. 3 is a view schematically explaining how the heat exchanger washing apparatus in FIG. 1 is used.
Figure 4:
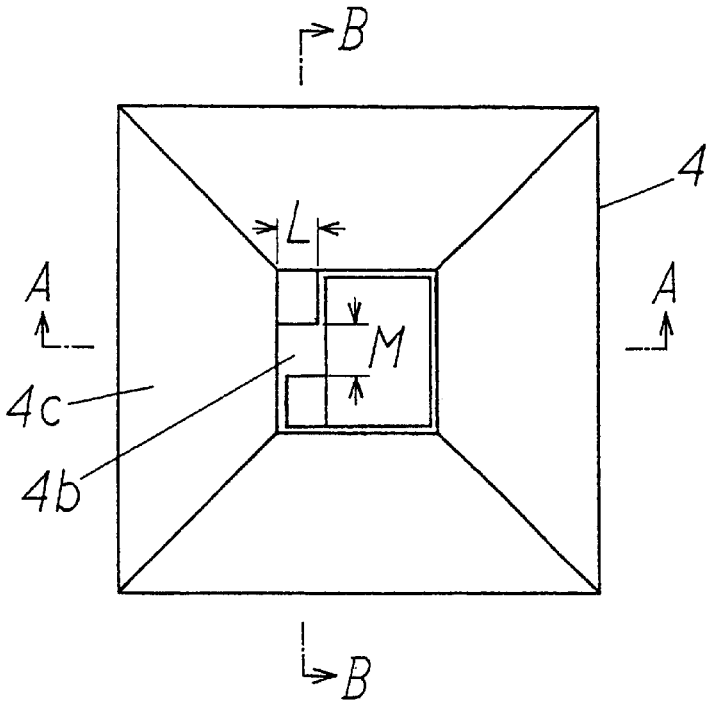
FIG. 4 is a schematic plan view of a hopper in FIG. 1.
Figure 5:
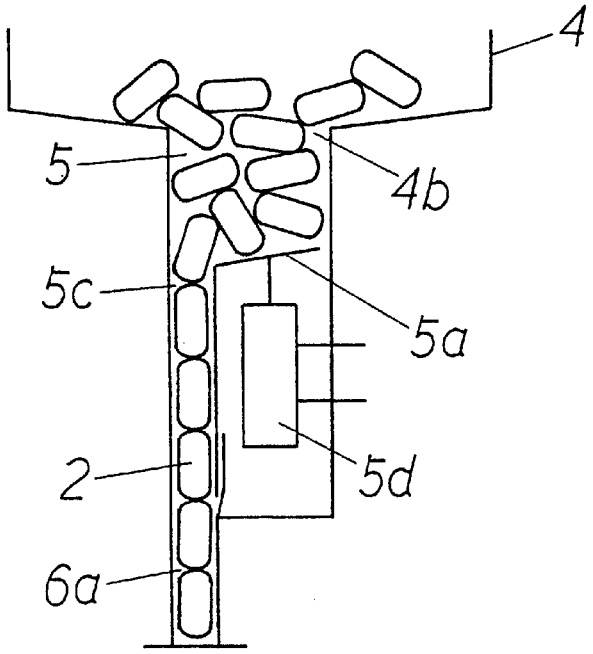
FIG. 5 is a schematic sectional view taken along the line A—A in FIG. 4 when a reciprocatingly moving member is lowered and shows how the hopper is used.
Figure 6:
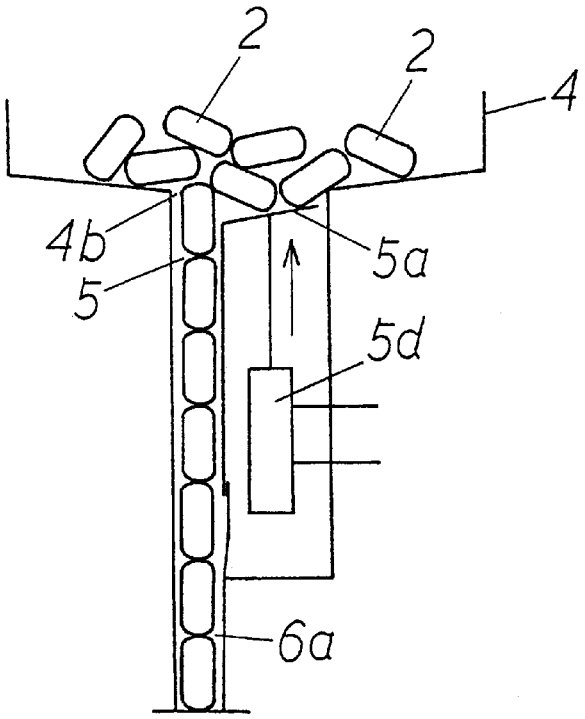
FIG. 6 is a schematic sectional view taken along the line A—A in FIG. 4 when the reciprocally moving member is lifted and shows how the hopper is used.
Figure 7:
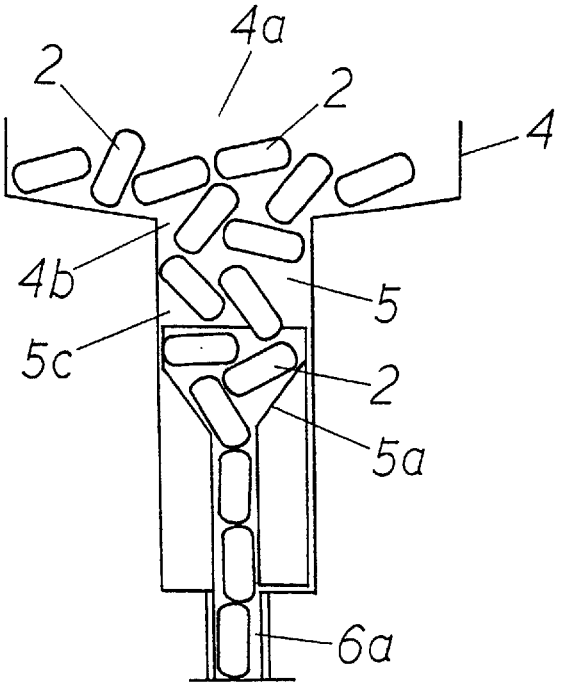
FIG. 7 is a schematic sectional view taken along the line B—B in FIG. 4 when the reciprocally moving member is lowered and shows how the hopper is used.
Figure 8:
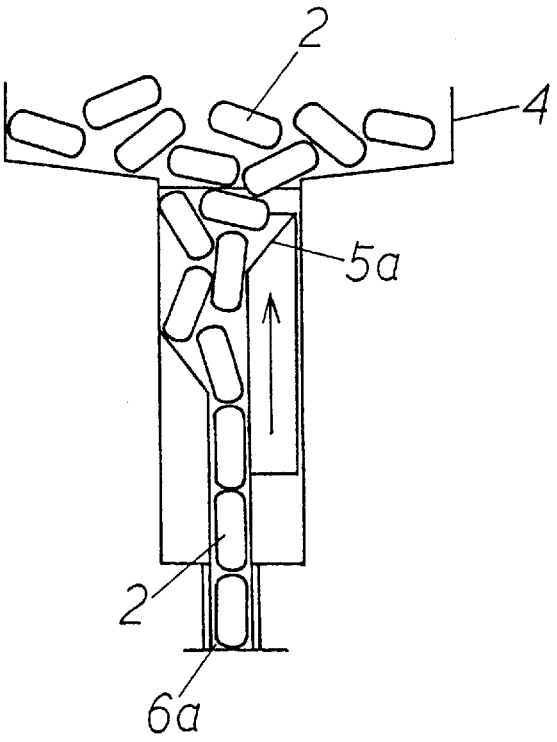
FIG. 8 is a schematic sectional view taken along the line B—B in FIG. 4 when the reciprocally moving member is lifted and shows how the hopper is used.

As shown in FIG. 2, a first holding portion 20 which will be held by a hand for actuating the lever 21 and a second holding portion 22 which will be held by a hand not actuating the lever 21 are disposed to the extreme end of the second guide passage 12*a*, respectively. Numeral 200 denotes a changeover switch which will be described later.

First stopper control means 101 keeps or releases the stop function of the first stopper 8. Although not shown, when, for example, the lever 21 is pulled, it is detected by a sensor or the like and the first stopper control means 101 electrically advances the rod 8*a* of the first stopper 8 so as to project it into the first guide passage 6*a*, so that the rod 8*a* exhibits the stopper function and the stop function of the first stopper 8 is kept, whereas when the lever 21 is returned, it is detected by the sensor or the like and the first stopper control means 101 electrically retreats the rod 8*a* of the first stopper 8 to thereby release the stop function of the first stopper 8.

Note, the first stopper control means 101 may be arranged such that when, for example, the lever 21 is pulled, the first stopper control means 101 advances the rod 8*a* so as to project it into the first guide passage 6*a* by, for example, the air in a not shown air passage in association with the pulled lever 21, so that the rod 8 exhibits the stopper function and the stop function of the first stopper 8 is kept, whereas when the lever 21 is returned, the first stopper control means 101 retreats the rod 8*a* by, for example, the air in the not shown air passage in association with the returned lever 21 to thereby release the stop function of the first stopper 8.

A first-dash stopper control means 101' is used to close the first opening/closing member 7 and opens the second opening/closing member 11 to thereby keep or release the stop function of the first-dash stopper 8'. Although not shown, when, for example, the changeover switch 200 is actuated, it is detected by a sensor or the like and the first-dash stopper control means 101' electrically advances the rod 8'*a* of the first-dash stopper 8' so as to project it into the first guide passage 6*a* to thereby keep the stop function of the first-dash stopper 8' as well as electrically closes the first opening/closing member 7 and opens second opening/closing member 11 so that only the air is introduced into the pipe 100 of the heat exchanger from the inserting portion 12*b*.

That is, there is a case that the washing brush 2 stops in the midway of the pipe 100 while the heat exchanger is being washed. In this case, even if another washing brush 2 is launched to discharge the stopped washing brush 2, the launched washing brush 2 is only stopped by being abutted against the stopped washing brush 2 and the washing brush 2 stopped in the midway of the pipe 100 cannot be removed.

Figure 13:
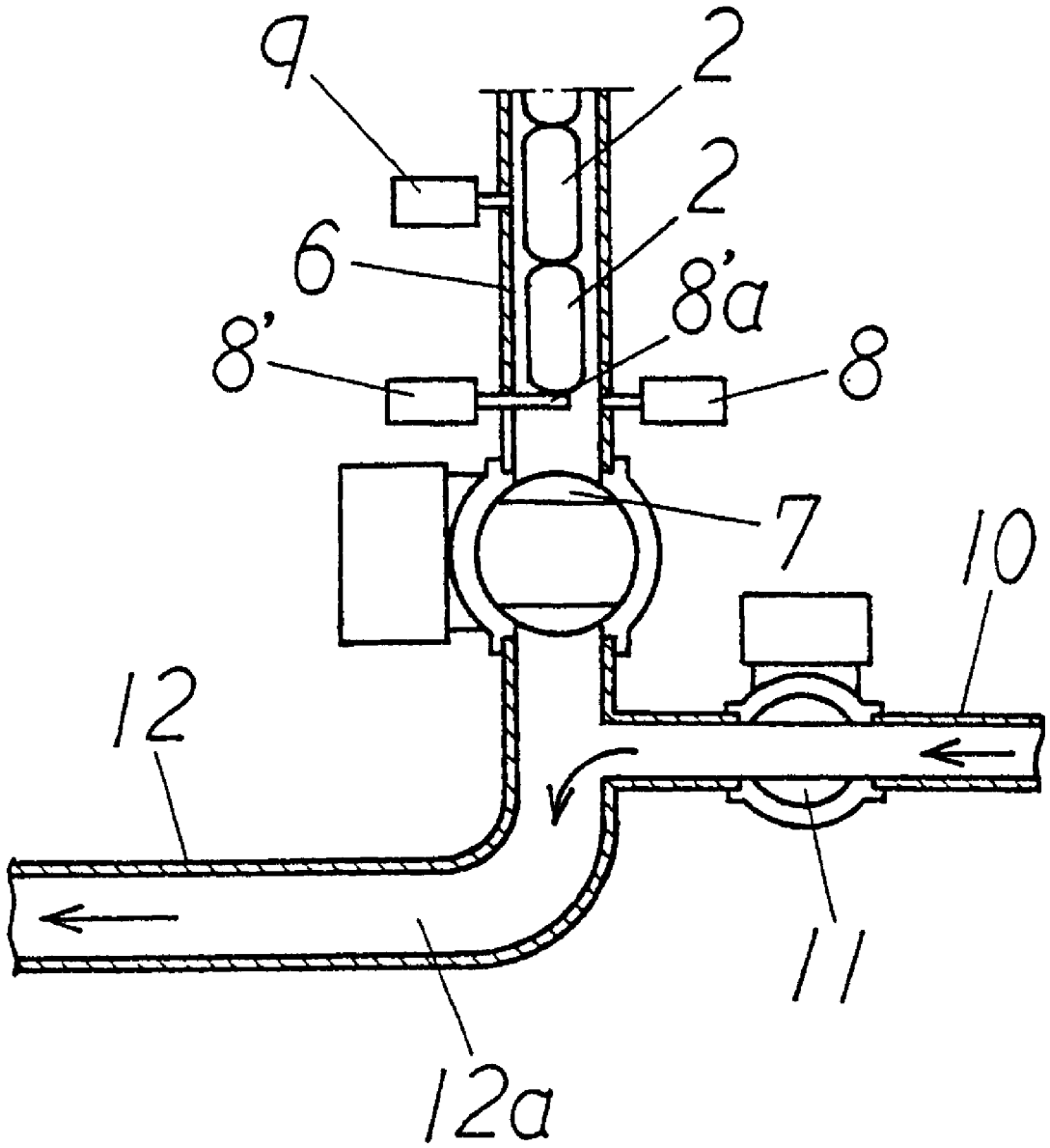
FIG. 13 shows the respective states of the rod of the first stopper, the rod of the first-dash stopper, the rod of the second stopper, the first opening/closing member and the second opening/closing member when a changeover switch is actuated.

In such a case, when the changeover switch 200 is actuated, the first opening/closing member 7 is closed, the second opening/closing member 11 is opened, the washing brush 2 is stopped by the first-dash stopper 8' (or the fist stopper 8) in association with the actuated changeover switch 200 as shown in FIG. 13 and only the air is introduced into the pipe 100 of the heat exchanger from the inserting portion 12*b*. As a result, the washing brush 2 stopped in the midway of the pipe 100 can be discharged.

Note, although not shown, the first-dash stopper control means 101' may be arranged such that when the changeover switch 200 is actuated, the first-dash stopper control means 101' advances the rod 8' by, for example, the air in the not shown air passage so as to project it into the first guide passage 6*a* in association with the actuated changeover switch 200, so that the stop function of the first stopper 8' is kept as well as the first opening/ closing member 7 is closed and the second opening/closing member 11 is opened by the air in the not shown air passage, and only the air is introduced into the pipe 100 of the heat exchanger from the inserting portion 12*b*.

A second stopper control means 102 keeps or releases the stop function of the second stopper 9. Although not shown, when, for example, the lever 21 is pulled, it is detected by the sensor or the like and the second stopper control means 102 electrically retreats the rod 9*a* of the second stopper 9 in association with the pulled lever 21 to thereby release the stop function of the second stopper 9, whereas when the lever 21 is returned, the second stopper control means 102 electrically advances the rod 9*a* of the second stopper 9 in association with the returned lever 21 so as to project it into the first guide passage 6*a,* so that the rod 9*a* exhibits the stopper function.

Note, the second stopper control means 102 may be arranged such that when, for example, the lever 21 is pulled, the second stopper control means 102 retreats the rod 9*a* by the air in the not shown air passage in association with the pulled lever 21 to thereby release the stop function of the second stopper 9, whereas when the lever 21 is returned, the second stopper control means 102 advances the rod 9*a* in association with the returned lever 21 so as to project it into the first guide passage 6*a,* so that the rod 9*a* exhibits the stopper function.

First opening/closing means 103 for opening and closing the first opening/closing member 7 is arranged such that when, for example, the lever 21 is pulled, it is detected by the sensor or the like and the first opening/closing means 103 acts to electrically close the first opening/closing member 7, whereas when the lever 21 is returned, it is detected by the sensor or the like and the first opening/closing means 103 acts to electrically open the first opening/closing member 7.

Note, the first opening/closing means 103 may be arranged such that when, for example, the lever 21 is pulled, the first opening/closing means 103 closes the first opening/closing member 7 by the air in the not shown air passage in association with the pulled lever 21, whereas when the lever 21 is returned, the first opening/closing means 103 opens the first opening/closing member 7 by the air in the not shown air passage in association with the returned lever 21.

Second opening/closing means 104 for opening and closing the second opening/closing member 11 is arranged such that although not shown, when, for example, the lever 21 is pulled, it is detected by the sensor or the like and the second opening/closing means 104 acts to electrically open the second opening/closing member 11, whereas when the lever 21 is returned, it is detected by the sensor or the like and the second opening/closing means 104 acts to electrically close the second opening/closing member 11.

Note, the second opening/closing means 104 may be arranged such that when, for example, the lever 21 is pulled, the second opening/closing means 104 opens the second opening/closing member 11 by the air in the not shown air passage in association with the pulled lever 21, whereas when the lever 21 is returned, the second opening/closing means 104 closes the second opening/closing member 11 by the air in the not shown air passage in association with the returned lever 21.

Reciprocal movement control means 105 for reciprocally moving the reciprocally moving member 5*a* is arranged such that although not shown, when, for example, the lever 21 is pulled, it is detected by the sensor or the like and the reciprocal movement control means 105 electrically lifts (or lowers) the rod of the cylinder 5*d* to thereby lift (or lower) the reciprocally moving member 5*a* connected to the rod, whereas when the lever 21 is returned, it is detected by the sensor or the like and the reciprocal movement control means 105 electrically lowers (or lifts) the rod of the cylinder 5*d* to thereby lower (or lift) the reciprocally moving member 5*a* connected to the rod.

Note, the reciprocal movement control means 105 may be arranged such that when, for example, the lever 21 is pulled, the reciprocal movement control means 105 lifts (or lowers) the rod of the cylinder 5*d* by, for example, the air in the not shown air passage in association with the pulled lever 21 to thereby lift (or lower) the reciprocally moving member 5*a* connected to the rod, whereas when the lever 21 is returned, the reciprocal movement control means 105 lowers (or lifts) the rod of the cylinder 5*d* by, for example, the air in the not shown air passage in association with the returned lever 21 to thereby lower (or lift) the reciprocally moving member 5*a* connected to the rod.

Figure 9:
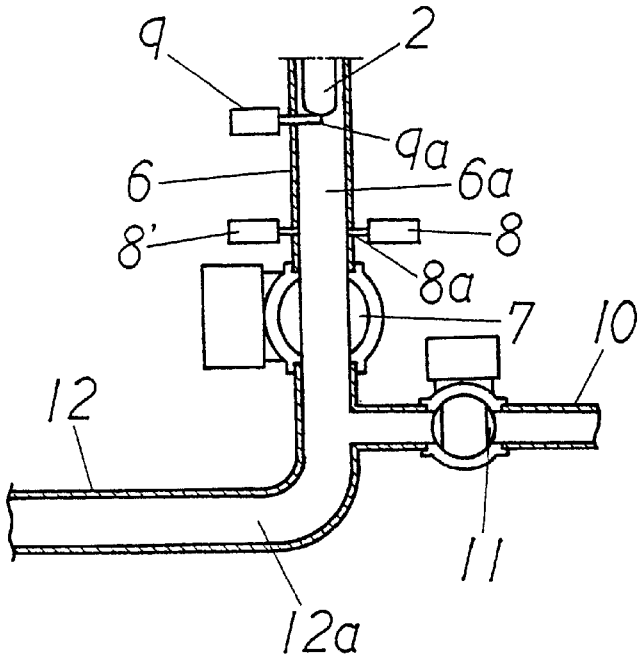
FIG. 9 is a view schematically showing the main portion of the present invention and shows the respective states of the rod of a first stopper, the rod of a first-dash stopper, the rod of a second stopper, a first opening/closing member and a second opening/closing member before a lever is actuated.

Therefore, at an ordinary time, that is, when the heat exchanger washing apparatus 1 is not used, the stop function of the first stopper 8 is released, the stop function of the first-dash stopper 8' is released, the stop function of the second stopper 9 is kept, the first opening/closing member 7 is opened and the second opening/closing member 11 is closed as shown in FIG. 9.

Figure 10:
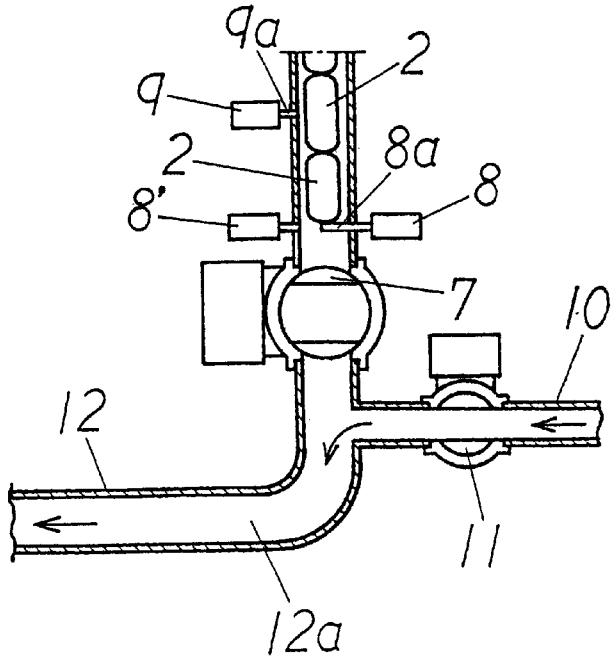
FIG. 10 shows the respective states of the rod of the first stopper, the rod of the first-dash stopper, the rod of the second stopper, the first opening/closing member and the second opening/closing member when the lever is pulled in the state shown in FIG. 9.
Figure 11:
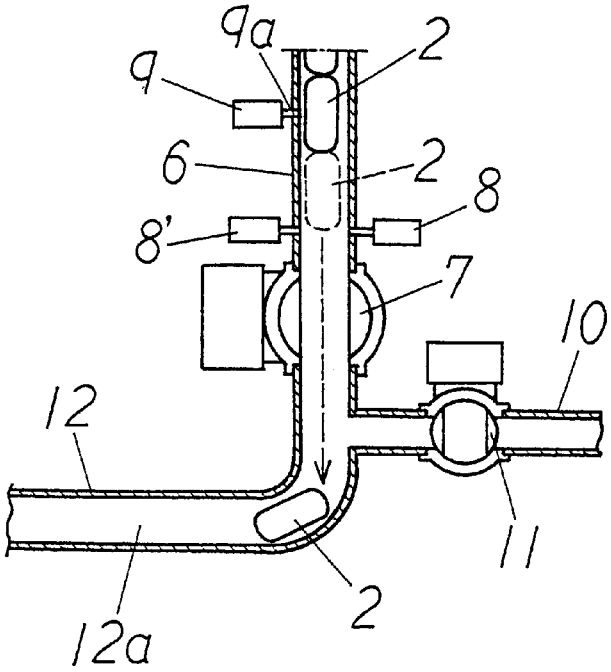
FIG. 11 shows the respective states of the rod of the first stopper, the rod of the first-dash stopper, the rod of the second stopper, the first opening/closing member and the second opening/closing member when the lever is returned in the state shown in FIG. 10.

Next, when the lever 21 is actuated, for example, it is pulled in the state that the inserting portion 12*b* is inserted into the pipe 100 of the heat exchanger, the first opening/closing member 7 is closed by the first opening/ closing means 103 and the second opening/closing member 11 is opened by the second opening/closing means 104 in association with the pulled lever 21 as well as the stop function of the first stopper 8 is kept by the first stopper control means 101 and the stop function of the second stopper 9 is released by the second stopper control means 102 as shown in FIG. 10, so that the washing brush 2 is held by the rod 9*a* of the second stopper 9 above the first opening/closing member 7.

Next, when the lever 21 is returned, the first opening/closing member 7 is opened by the first opening/closing means 103 and the second opening/closing member 11 is closed by the second opening/closing means 104 in association with the returned lever 21 as well as the stop function of the first stopper 8 is released by the first stopper control means 101 to thereby permit the washing brush 2 to naturally drop and to be introduced into the second guide passage 12*a* and the stop function of the second stopper 9 is kept by the second stopper control means 102 to thereby hold the washing brush 2 located on the dropped washing brush 2.

Figure 12:
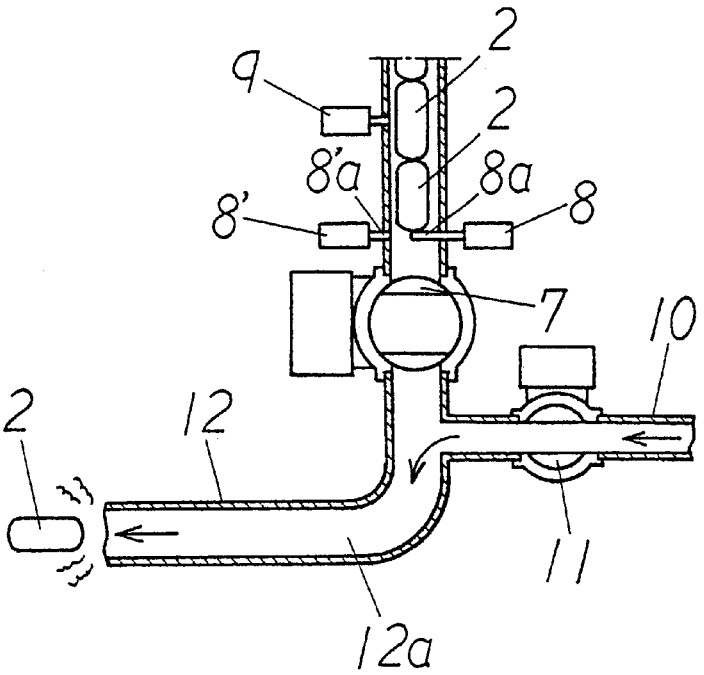
FIG. 12 shows the respective states of the rod of the first stopper, the rod of the first-dash stopper, the rod of the second stopper, the first opening/closing member and the second opening/closing member when the lever is pulled in the state shown in FIG. 11.

Thereafter, when the lever 21 is pulled again, the first opening/closing member 7 is closed by the first opening/closing means 103 and the second opening/closing member 11 is opened by the second opening/closing means 104 in association with the pulled lever 21, so that the washing brush 2 in the second guide passage 12*a* is launched from the inserting portion 12*b* by the air from the air introduction passage 10 and caused to travel in the pipe 100 of the heat exchanger and discharged to the outside of the pipe 100 of the heat exchanger together with the material deposited on the inner surface of the pipe 100 as shown in FIG. 12.

Thereafter, the lever 21 is returned and then the inserting portion 12*b* is inserted into the pipe 100 of the heat exchanger which is desired to be cleaned and the cleaning job is carried out by pulling the lever 21 likewise the above process. The heat exchanger can be cleaned by repeating the cleaning job to the respective pipes 100 of the heat exchanger which are desired to be cleaned.

According to the embodiment, the supply of the washing brush 2 to the second guide passage 12*a* can be stopped by opening the first opening/closing member 7, closing the second opening/closing member 11 and stopping and holding the washing brush 2 by the second stopper 9. At the time, since the stop function of the first stopper 8 is released, even if a piece of the washing brush 2 which has a slightly different height such as the one conventionally used has been supplied below the washing brush 2 stopped by the second stopper 9, the supplied washing brush is not broken, can be securely introduced into the second guide passage 12*a* and caused to travel in the pipe of the heat exchanger and can discharge the material deposited on the inner wall of the pipe of the heat exchanger to the outside of the pipe.

Note, the operation of the first stopper rod 8*a,* the first-dash stopper rod 8'*a* and the second stopper rod 9*a* can be adjusted by a not shown speed controller.

According to the invention of claim 1, the supply of a washing brush to the second guide passage can be stopped by opening the first opening/closing member, closing the second opening/closing member and stopping and holding the washing brush by the second stopper. At the time, since the stop function of the first stopper is released, even if a piece of the washing brush which has a slightly different height such as the one conventionally used has been supplied below the washing brush stopped by the second stopper, the supplied washing brush is not broken, can be securely introduced into the second guide passage and caused to travel in the pipe of the heat exchanger and can discharge the material deposited on the inner wall of the pipe of the heat exchanger to the outside of the pipe.

According to the invention of claim 2, the supply of a washing brush to the second guide passage can be stopped by opening the first opening/closing member, closing the second opening/closing member and stopping and holding the washing brush by the second stopper. At the time, since the stop function of the first stopper is released, even if a piece of the washing brush which has a slightly different height such as the one conventionally used has been supplied below the washing brush stopped by the second stopper, the supplied washing brush is not broken, can be securely introduced into the second guide passage and caused to travel in the pipe of the heat exchanger and can discharge the material deposited on the inner wall of the pipe of the heat exchanger to the outside of the pipe.

According to the invention of claim 3, since only air can be introduced into the pipe of the heat exchanger from the inserting portion without introducing a washing brush into the second guide passage, a washing brush which stops in the midway of the heat exchanger can be discharged to the outside of the pipe of the heat exchanger, whereby a trouble which arises while the heat exchanger is being cleaned can be removed, in addition to the advantage of the invention according to claim 2.

According to the invention of claim 4, the reciprocally moving member is reciprocally moved in the perpendicular direction and washing brushes can be automatically supplied in a standing state from the inlet of the opening. As a result, the washing brushes need not be supplied one by one in the standing state by an operator as conventionally required and it suffices only to supply the washing brushes at random, by which workability can be greatly improved.

What is claimed is:

1. A heat exchanger washing apparatus (1), characterized by comprising:

a hopper (4) for accommodating a plurality of washing brushes (2);

a first heat exchanger leading guide (6) standing on said hopper by being connected thereto and having a first guide passage (6*a*) for guiding the washing brushes (2) from said hopper (4);

a first opening/closing member (7) for opening and closing the first guide passage (6*a*);

a first stopper (8) disposed to the first guide passage (6*a*) upstream of the portion thereof where said first opening/closing member (7) is disposed for stopping the washing brushes (2);

a second stopper (9) disposed to the first guide passage (6*a*) upstream of the portion thereof where said first stopper (8) is disposed for stopping the washing brushes (2);

an air introduction passage (10) communicating with the connecting port (6*b*) of the first guide passage (6*a*) downstream of the portion thereof where said first opening/closing member (7) is disposed;

a second opening/closing member (11) for opening and closing said air introduction passage (10);

a second heat exchanger leading guide (12) connected to the first guide passage (6*a*) downstream of the connecting port (6*b*) and having a second guide passage (12*a*) for guiding the washing brushes (2) with the extreme end of the second guide passage (12*a*) serving as an inserting portion (12*b*) which will be inserted into the pipe of a heat exchanger;

first stopper control means (101) for keeping or releasing the stop function of said first stopper (8);

second stopper control means (102) for keeping or releasing the stop function of said second stopper (9);

first opening/closing control means (103) for opening or closing said first opening/closing member (7); and second opening/closing control means (104) for opening or closing said second opening/closing member (11) .

* * * * *